US009501937B2

(12) United States Patent
Bruce et al.

(10) Patent No.: US 9,501,937 B2
(45) Date of Patent: Nov. 22, 2016

(54) SYSTEMS AND METHOD OF CONTROLLING AIRPORT TRAFFIC

(71) Applicant: The Boeing Company, Huntington Beach, CA (US)

(72) Inventors: Jeffery Leon Bruce, Newnan, GA (US); Andrew David McDowell, Suwanee, GA (US)

(73) Assignee: The Boeing Company, Chicago, IL (US)

( * ) Notice: Subject to any disclaimer, the term of this patent is extended or adjusted under 35 U.S.C. 154(b) by 161 days.

(21) Appl. No.: 14/330,514

(22) Filed: Jul. 14, 2014

(65) Prior Publication Data

US 2016/0012734 A1 Jan. 14, 2016

(51) Int. Cl.

| | |
|---|---|
| ***G08G 5/00*** | (2006.01) |
| ***G08G 5/02*** | (2006.01) |
| ***G08G 5/04*** | (2006.01) |

(52) U.S. Cl.

CPC ..... *G08G 5/0043* (2013.01); *G08G 5/003* (2013.01); *G08G 5/0013* (2013.01); *G08G 5/0017* (2013.01); *G08G 5/0082* (2013.01); *G08G 5/025* (2013.01); *G08G 5/045* (2013.01)

(58) Field of Classification Search

CPC . G08G 5/0013; G08G 5/0017; G08G 5/0043

USPC ..... 701/16

See application file for complete search history.

(56) References Cited

U.S. PATENT DOCUMENTS

| | | | | |
|---|---|---|---|---|
| 8,515,597 | B2 | 8/2013 | McDowell et al. | |
| 2010/0217510 | A1* | 8/2010 | Deker | G08G 5/045 701/120 |
| 2011/0144832 | A1* | 6/2011 | McDowell | G08G 5/0043 701/3 |
| 2014/0097972 | A1* | 4/2014 | Barraci | G01C 23/005 340/971 |

OTHER PUBLICATIONS

McAnulty and Zingale, "Pilot-Based Spacing and Separation on Approach to Landing: The Effect on Air Traffic Controller Workload and Performance". Dec. 2005. Found at <http://actlibrary.tc.faa.gov>.*

* cited by examiner

*Primary Examiner* — John Q Nguyen
*Assistant Examiner* — Anshul Sood
(74) *Attorney, Agent, or Firm* — Armstrong Teasdale LLP

(57) ABSTRACT

A method of controlling airport traffic is provided. The method includes routing a plurality of aircraft towards a runway and selecting a runway approach vector for each of the plurality of aircraft. First approach legs of each runway approach vector are separated from each other by a distance.

20 Claims, 3 Drawing Sheets

SYSTEMS AND METHOD OF CONTROLLING AIRPORT TRAFFIC

BACKGROUND

The field of the present disclosure relates generally to required navigation performance (RNP) procedures and, more specifically, to RNP procedures including offset runway approach vectors for incoming aircraft.

Required Navigation Performance refers generally to a performance-based navigation (PBN) procedure including navigation containment and monitoring. An RNP system allows an aircraft navigation system to monitor its achieved navigation performance, and to identify whether operational requirements are being met during operation. RNP capability of an aircraft is a major component in determining separation criteria between an aircraft in flight and foreign objects to ensure that target levels of safety are met. For example, when implementing an RNP procedure, the aircraft must be qualified and capable of flying with an actual navigation precision equal to, or greater than, a required navigation performance prescribed by the procedure.

Aircraft using RNP procedures are required to navigate themselves accurately in accordance with a predetermined procedure. RNP procedures are now mandatory for certain difficult to navigate, terrain-challenged airports, such as those in Tibet, in Alaska, and in very high-altitude mountainous areas in South America. Some of these known airports have no direct approach vectors. Rather, the airports only have approach vectors with mountainous terrain on both sides such that the aircraft must be precisely maneuvered to navigate these approaches.

Aircraft manufacturers and operators have been exploring the application of RNP to runway approach vectors for use with other more easily navigable airports to facilitate ensuring target levels of safety are met for nearby approaching aircraft. For example, one such air traffic control procedure implementing RNP runway approach vectors is referred to as a "trombone" approach pattern. The trombone approach pattern includes routing approaching aircraft along the same downwind leg, and routing each of the approaching aircraft along differing radius-to-fix base legs towards a runway, which facilitates separating each aircraft at safe distances. However, when multiple approaching aircraft are traveling along the downwind leg substantially simultaneously, it may be difficult for an air traffic controller to determine whether each aircraft will eventually follow its designated base leg route.

BRIEF DESCRIPTION

In one aspect, a method of controlling airport traffic is provided. The method includes routing a plurality of aircraft towards a runway and selecting a runway approach vector for each of the plurality of aircraft. First approach legs of each runway approach vector are separated from each other by a distance.

In another aspect, a navigational control system for use in an aircraft is provided. The navigational control system includes an autopilot system, a receiver configured to receive a signal including runway approach flight plan data, and a controller in communication with the autopilot system and the receiver. The controller includes a processor and a memory storing data including a plurality of runway approach vectors that each include first approach legs separated from each other by a distance. The controller is configured to receive a selection of one of the plurality of runway approach vectors, and instruct the autopilot system to execute the selected runway approach vector. The selection is based on the runway approach flight plan data included in the signal.

In yet another aspect, an air traffic control system for use in routing a plurality of aircraft towards a runway is provided. The system includes a transmitter, and a controller in communication with the transmitter. The controller includes a processor and a memory storing data including a plurality of runway approach vectors that each include first approach legs separated from each other by a distance. The controller is configured to receive a selection of different runway approach vectors for each of the plurality of aircraft, and instruct the transmitter to transmit a signal to each of the plurality of aircraft. Each signal includes the selected runway approach vectors.

DETAILED DESCRIPTION

The implementations described herein relate to systems and methods of controlling airport traffic. In the exemplary implementation, a navigational control system of an aircraft and an air traffic control system are utilized in conjunction to ensure target levels of safety are met for aircraft routed towards a runway substantially simultaneously. Specifically, each aircraft has a designated runway approach vector selected by the air traffic control system, and the selection is transmitted to the aircraft for execution by an autopilot system. Each runway approach vector includes first approach legs separated from each other by a distance. Separating the first approach legs facilitates providing a visual indication that the aircraft are traveling along the correct runway approach vector before base leg and final approach maneuvers are executed. As such, the system and method described herein facilitate reducing an amount of communication between an air traffic controller and a pilot of the aircraft to verify that the aircraft are traveling along the correct flight path.

Figure 1:
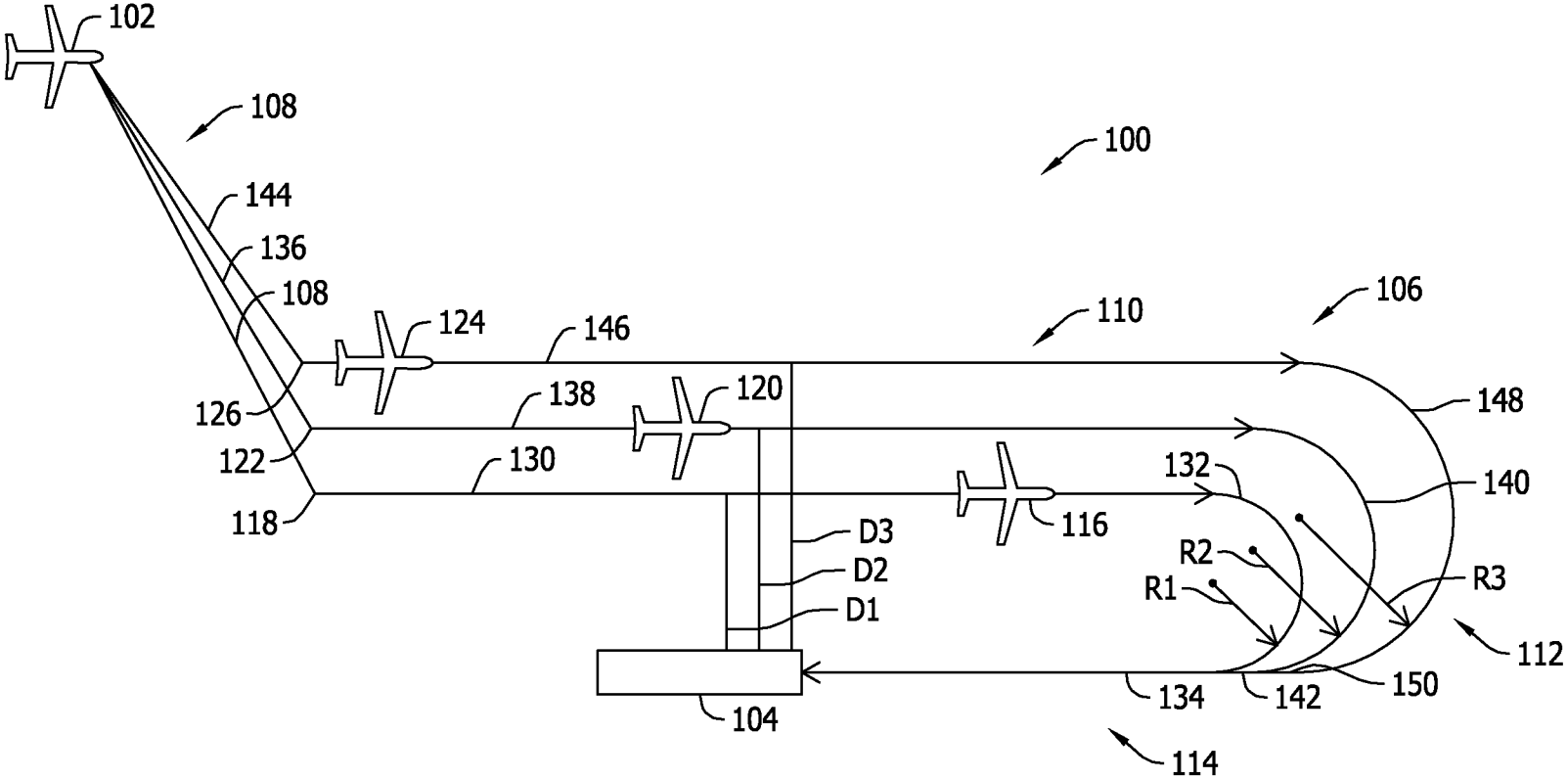
FIG. 1 is a schematic illustration of an exemplary air traffic control procedure.

FIG. 1 is a schematic illustration of an exemplary air traffic control procedure 100. In the exemplary implementation, air traffic control procedure 100 includes a plurality of approaching aircraft represented by aircraft 102, a runway 104, and a plurality of runway approach vectors 106 for aircraft 102 to travel along and reach runway 104. Each runway approach vector 106 includes an entry leg 108, a first approach leg 110, a base leg 112, and a final approach leg 114. The number of runway approach vectors 106 included in air traffic control procedure 100 is based on a number of aircraft 102 approaching runway 104. Each aircraft 102 is routed towards runway 104 along a different runway approach vector 106. Adjacent runway approach vectors 106 are separated from each other by a predetermined distance to ensure separation criteria between aircraft 102 traveling along each runway approach vector 106 are maintained. Moreover, separating runway approach vectors 106 facilitates providing a visual indication of a real-time position of aircraft 102 to an air traffic controller (not shown in FIG. 1). As such, runway approach vectors 106 are separated from each other at successive intervals as the number of aircraft 102 routed towards runway 104 increases.

For example, in the exemplary implementation, a first aircraft 116 is routed towards runway 104 along a first runway approach vector 118, a second aircraft 120 is routed towards runway 104 along a second runway approach vector 122, and a third aircraft 124 is routed towards runway 104 along a third runway approach vector 126. First runway approach vector 118 includes a first entry leg 128, a first approach leg 130, a first turn-to-final leg 132, and a first final approach leg 134. Second runway approach vector 122 includes a second entry leg 136, a second approach leg 138, a second turn-to-final leg 140, and a second final approach leg 142. Third runway approach vector 126 includes a third entry leg 144, a third approach leg 146, a third turn-to-final leg 148, and a third final approach leg 150. While shown as extending in a direction substantially parallel to runway 104, approach legs 110 may be oriented relative to runway 104 at any angle that enables the flight procedures to function as described herein. For example, in the exemplary implementation, approach legs 110 oriented substantially parallel to runway 104 extend in a substantially downwind direction.

Approach legs 110 are at successively greater distances from runway 104 as the number of aircraft 102 routed towards runway 104 increases. For example, first approach leg 130 is a first distance D1 from runway 104, second approach leg 138 is a second distance D2 from runway 104, and third approach leg 146 is a third distance D3 from runway 104. Distance D2 is greater than distance D1, and distance D3 is greater than distance D2. As such, visual separation between aircraft 102 is maintained even when aircraft 102 are at the same position along respective first approach legs 110. Moreover, plotting first approach legs 110 at successively greater distances from runway 104 facilitates verifying each aircraft 116, 120, and 124 is traveling on the correct runway approach vector 106 before being maneuvered into turn-to-final legs 112.

Turn-to-final legs 112 correspondingly increase in size as the distance of first approach legs 110 from runway 104 increases to ensure aircraft 102 reach runway 104. In some implementations, turn-to-final legs 112 are radius-to-fix (RF) legs having a substantially constant radius and whose radii increase as the distance of first approach legs 110 from runway 104 increases. For example, first turn-to-final leg 132 has a first radius R1, second turn-to-final leg 140 has a second radius R2, and third turn-to-final leg 148 has a third radius R3. Radius R2 is greater than radius R1, and radius R3 is greater than radius R2. Moreover, final approach legs 134, 142, and 150 are plotted to substantially overlap with each other. In an alternative implementation, turn-to-final legs 112 without a constant radius may be implemented in runway approach vectors 106.

Figure 2:
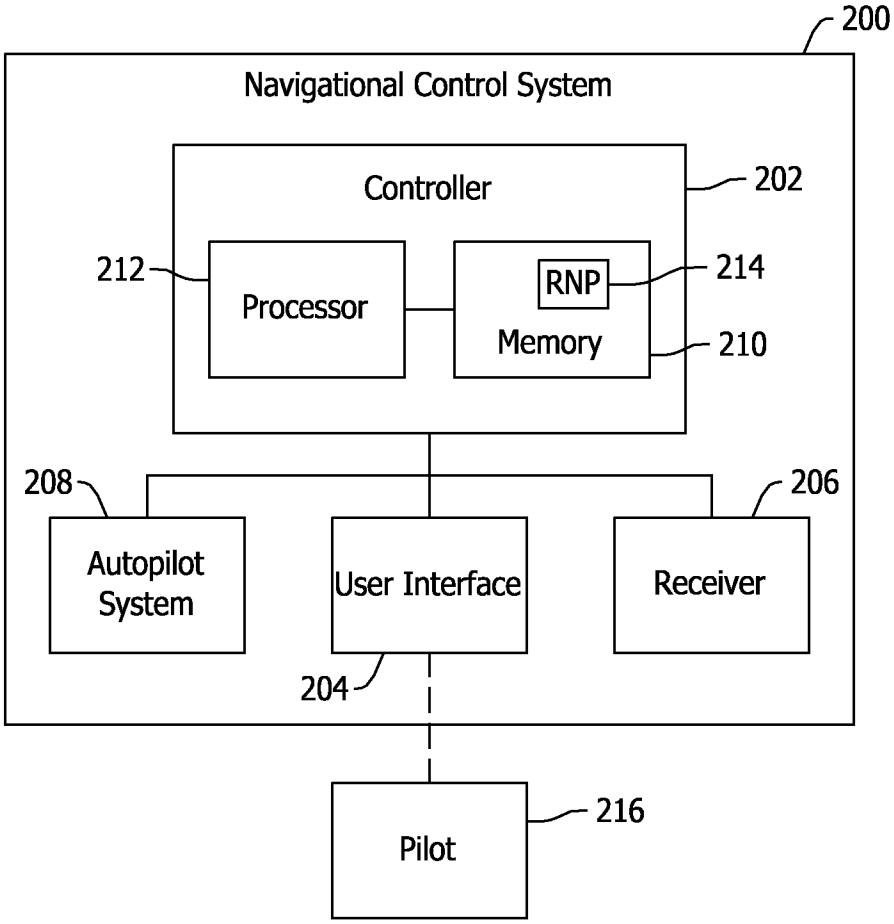
FIG. 2 is a block diagram of an exemplary navigational control system for use with the aircraft shown in FIG. 1.

FIG. 2 is a block diagram of an exemplary navigational control system 200 for use with aircraft 102 (shown in FIG. 1). In the exemplary implementation, navigational control system 200 includes a controller 202, a user interface 204, a receiver 206, and an autopilot system 208. Controller 202 includes a memory 210 and a processor 212 coupled to memory 210 for executing programmed instructions. Navigational control system 200 also includes required navigation performance (RNP) procedure module 214 stored within memory 210. RNP procedure module 214 stores and facilitates executing a runway approach flight plan for aircraft 102. Specifically, RNP procedure module 214 stores data including predetermined runway approach vectors 106 (shown in FIG. 1) that may be selectively executed by autopilot system 208. Recommended flight parameters such as predetermined speeds and altitudes along each runway approach vector 106 may also be defined and stored in RNP procedure module 214. As will be described in more detail below, the selection of runway approach vector 106 to be executed by autopilot system 208 is based on runway approach flight plan data received by receiver 206.

In operation, receiver 206 receives a signal including predetermined runway approach flight plan data for aircraft 102 from an air traffic control system (not shown in FIG. 2). The predetermined runway approach flight plan data includes a runway approach vector selection designated by the air traffic control system. The runway approach vector selection is unique to each aircraft 102 routed towards runway 104. Upon receiving the signal, controller 202 facilitates selecting one of runway approach vectors 106 stored in RNP procedure module 214 that corresponds to the runway approach vector selection. Controller 202 then instructs autopilot system 208 to execute the selected runway approach vector 106. In one implementation, the signal is an audio transmission from an air traffic controller (not shown in FIG. 2) to a pilot 216 of aircraft 102, and runway approach vector 106 is selected when pilot 216 manually inputs the runway approach vector selection into navigational control system 200 via user interface 204.

Figure 3:
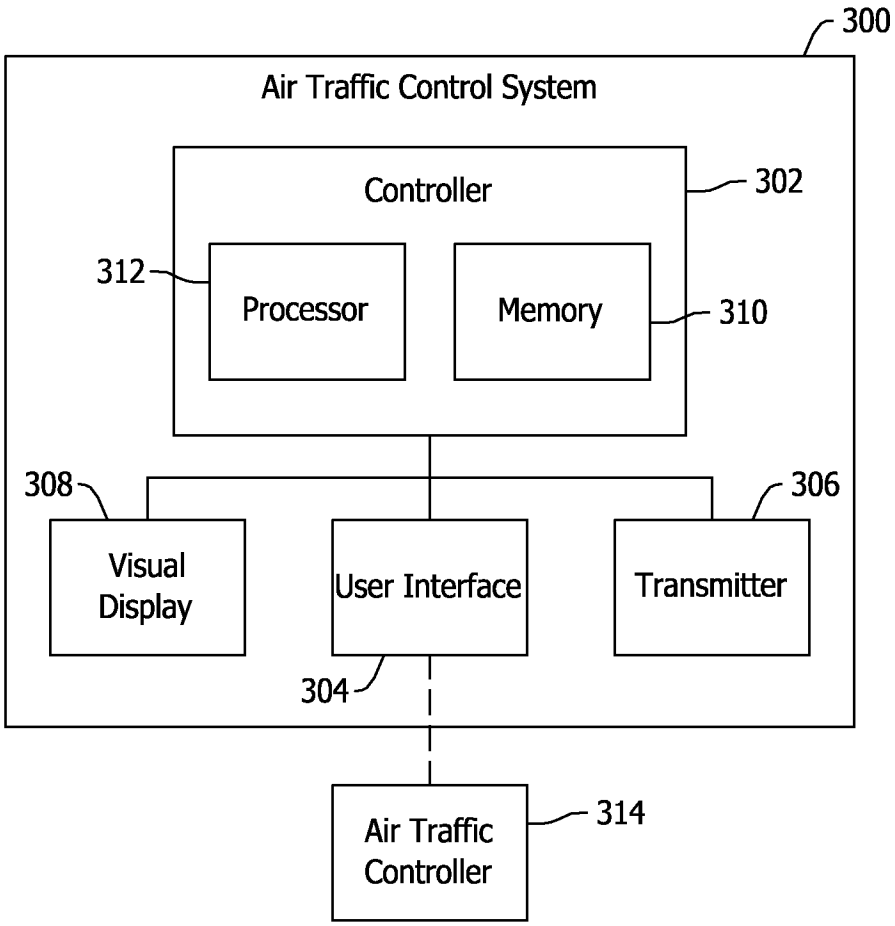
FIG. 3 is a block diagram of an exemplary air traffic control system.

FIG. 3 is a block diagram of an exemplary air traffic control (ATC) system 300. In the exemplary implementation, ATC system 300 includes a controller 302, a user interface 304, and a transmitter 306. Controller 302 includes a memory 310 and a processor 312 coupled to memory 310 for executing programmed instructions. ATC system 300 also includes a visual display 308 that facilitates enabling an air traffic controller 314 to monitor a position of aircraft 102 routed towards runway 104 (each shown in FIG. 1). Specifically, as will be described in more detail below, visual display 308 provides a visual indication of a real-time position of aircraft 102 such that air traffic controller 314 can verify that aircraft 102 are traveling along selected runway approach vectors 106 (shown in FIG. 1).

In the exemplary implementation, memory 310 stores and facilitates executing runway approach flight plans for aircraft 102. Specifically, memory 310 stores data including predetermined runway approach vectors 106 that may be selectively transmitted to aircraft 102. Recommended flight parameters such as predetermined speeds and altitudes for each runway approach vector 106 may also be defined and stored in memory 310, and selectively transmitted to aircraft 102. As will be described in more detail below, ATC system 300 facilitates selecting a different runway approach vector 106 for each aircraft 102 routed towards runway 104 (shown in FIG. 1).

In operation, aircraft 102 may be routed towards runway 104 along runway approach vectors 106 in any sequence that enables air traffic control procedure 100 to function as described herein. Specifically, air traffic controller 314 facilitates routing aircraft 102 towards runway 104, and is able to determine a position of each aircraft 102 by viewing visual display 308. To ensure separation criteria between aircraft 102 are maintained, air traffic controller 314 selects a different runway approach vector 106 for each aircraft 102 routed towards runway 104. In one implementation, controller 302 retrieves data from memory 310 that includes the predetermined runway approach vectors 106, and displays the predetermined runway approach vectors 106 on visual display 308. Air traffic controller 314 interacts with user interface 204 to select which runway approach vector 106 that each aircraft 102 should execute. After runway approach vectors 106 for each aircraft 102 have been selected, controller 302 instructs transmitter 306 to transmit a signal to each aircraft 102. For example, as shown in FIG. 1, a first signal is transmitted to first aircraft 116, a second signal is transmitted to second aircraft 120, and a third signal is transmitted to third aircraft 124. Each signal includes data corresponding to which runway approach vector 106 stored in RNP procedure module 214 (shown in FIG. 2) that aircraft 102 should execute. In an alternative implementation, controller 302 selects runway approach vectors 106 for aircraft 102 automatically without user input.

In some implementations, controller 302 provides an alert to air traffic controller 314 if aircraft 102 deviate from their selected runway approach vectors 106. For example, the alert may be provided if aircraft 102 deviate from their selected runway approach vectors 106 by more than a predetermined distance. Alternatively, monitoring a real-time position of aircraft 102 relative to runway approach vectors 106 may be performed manually.

The implementations described herein relate to systems and methods of air traffic control that facilitate reducing an amount of communication between a pilot of an aircraft and an air traffic controller to ensure target levels of safety are maintained between approaching aircraft routed towards a runway. In the exemplary implementation, a navigational control system of the aircraft and an air traffic control system are utilized in conjunction to select and execute predetermined runway approach vectors for the aircraft. The predetermined runway approach vectors each include approach legs separated from each other by a distance. Separating the approach legs facilitates providing a visual indication to the air traffic controller that the aircraft is traveling along the correct predetermined runway approach vector, thereby ensuring target levels of safety are met for the approaching aircraft. As such, air traffic controllers can easily verify that aircraft approaching the runway are traveling along a designated runway approach vector, which allows the air traffic controllers to focus on other tasks.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of controlling airport traffic, said method comprising:

routing a plurality of aircraft towards a runway; and selecting a runway approach vector for each of the plurality of aircraft, wherein first approach legs of each runway approach vector are parallel to each other and separated from each other by a predetermined lateral distance measured relative to the runway during an approach phase of each of the plurality of aircraft.

2. The method in accordance with claim 1, wherein selecting a runway approach vector comprises plotting the first approach legs of each runway approach vector at successively greater distances from the runway.

3. The method in accordance with claim 2 further comprising plotting a turn-to-final leg for each of the first approach legs, wherein a size of each turn-to-final leg increases as the first approach legs are spaced at the successively greater distances from the runway.

4. The method in accordance with claim 3 further comprising plotting a final approach leg for each turn-to-final leg thereby forming a plurality of final approach legs, wherein the plurality of final approach legs substantially overlap with each other.

5. The method in accordance with claim 1 further comprising defining a plurality of flight parameters for each runway approach vector, the plurality of flight parameters including at least one of speed or altitude of the aircraft.

6. The method in accordance with claim 1 further comprising monitoring a position of the plurality of aircraft to verify each of the plurality of aircraft are traveling along the selected runway approach vector.

7. The method in accordance with claim 6, wherein monitoring a position of the plurality of aircraft comprises determining whether the plurality of aircraft are traveling along the selected runway approach vectors before being maneuvered into a turn-to-final leg of each runway approach vector.

8. A navigational control system for use in an aircraft, said navigational control system comprising:

an autopilot system;

a receiver configured to receive a signal including runway approach flight plan data; and a controller in communication with said autopilot system and said receiver, said controller comprising a processor and a memory storing data including a plurality of runway approach vectors that each include first approach legs parallel to each other and separated from each other by a predetermined lateral distance measured relative to the runway during an approach phase of the aircraft, said controller configured to:

receive a selection of one of the plurality of runway approach vectors, the selection based on the runway approach flight plan data included in the signal; and instruct said autopilot system to execute the selected runway approach vector.

9. The system in accordance with claim 8 further comprising a user interface in communication with said controller, wherein said user interface facilitates manual input of the selection of one of the plurality of runway approach vectors.

10. The system in accordance with claim 8, wherein said memory stores flight parameters for each of the plurality of runway approach vectors, said controller further configured to instruct said autopilot system to execute the flight parameters corresponding with the selected runway approach vector.

11. The system in accordance with claim 10, wherein said memory stores flight parameters including at least one of speed or altitude of the aircraft along the plurality of runway approach vectors.

12. The system in accordance with claim 8, wherein said memory stores runway approach vector data including the first approach legs of each runway approach vector plotted at successively greater distances from the runway.

13. The system in accordance with claim 12, wherein said memory stores runway approach vector data including a turn-to-final leg plotted for each of the first approach legs, wherein a size of each turn-to-final leg increases as the downwind first approach legs are spaced at the successively greater distances from the runway.

14. An air traffic control system for use in routing a plurality of aircraft towards a runway, said system comprising:

a transmitter; and a controller in communication with said transmitter, said controller comprising a processor and a memory storing data including a plurality of runway approach vectors that each include first approach legs parallel to each other and separated from each other by a predetermined lateral distance measured relative to the runway during an approach phase of each of the plurality of aircraft, said controller configured to:

receive a selection of different runway approach vectors for each of the plurality of aircraft; and instruct said transmitter to transmit a signal to each of the plurality of aircraft, wherein each signal includes the selected runway approach vectors.

15. The system in accordance with claim 14 further comprising a user interface in communication with said controller, wherein said user interface facilitates selection of the different runway approach vectors by an air traffic controller.

16. The system in accordance with claim 15 further comprising a visual display in communication with said controller, wherein said controller is further configured to display the plurality of runway approach vectors on the visual display for viewing by the air traffic controller.

17. The system in accordance with claim 14, wherein said controller is further configured to provide an alert if the plurality of aircraft deviate from the selected runway approach vectors.

18. The system in accordance with claim 14, wherein said memory stores runway approach vector data including the first approach legs of each runway approach vector plotted at successively greater distances from the runway.

19. The system in accordance with claim 18, wherein said memory stores runway approach vector data including a turn-to-final leg plotted for each of the first approach legs, wherein a size of each turn-to-final leg increases as the first approach legs are spaced at the successively greater distances from the runway.

20. The system in accordance with claim 19, wherein said memory stores runway approach vector data including each turn-to-final leg plotted with a substantially constant radius.

* * * * *